US008381385B2

(12) United States Patent
Jha et al.

(10) Patent No.: US 8,381,385 B2
(45) **Date of Patent: *Feb. 26, 2013**

(54) SHAPED DIRECT CHILL ALUMINUM INGOT

(75) Inventors: Gyan Jha, Louisville, KY (US); J. David Brown, Louisville, KY (US); Shridas Ningileri, Lexington, KY (US); Weimin Yin, Lexington, KY (US); Randall Bowers, Lexington, KY (US)

(73) Assignee: Tri-Arrows Aluminum Inc., Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/218,438

(22) Filed: Jul. 15, 2008

(65) Prior Publication Data

US 2009/0000346 A1 Jan. 1, 2009

Related U.S. Application Data

(63) Continuation-in-part of application No. 11/286,401, filed on Nov. 25, 2005, now abandoned.

(60) Provisional application No. 60/639,210, filed on Dec. 27, 2004.

(51) Int. Cl.
*B21B 1/46* (2006.01)
*B21B 13/22* (2006.01)
*B22D 7/06* (2006.01)

(52) U.S. Cl. ..... 29/527.7; 29/527.6; 29/527.5; 72/365.2; 72/199; 249/174

(58) Field of Classification Search ..... 29/527.5, 29/527.6, 527.7, 557; 72/199, 203, 206, 72/365.2; 249/174, 160
See application file for complete search history.

(56) References Cited

U.S. PATENT DOCUMENTS

| | | | | | |
|---|---|---|---|---|---|
| 321,658 | A | * | 7/1885 | Sweet | 428/583 |
| 1,417,246 | A | * | 5/1922 | Hazeltine | 428/585 |
| 1,603,518 | A | | 10/1926 | Coates | |
| 1,611,020 | A | * | 12/1926 | Gathmann | 249/114.1 |
| 1,673,778 | A | * | 6/1928 | Haig | 249/160 |
| 1,989,096 | A | * | 1/1935 | Jones | 249/62 |
| 2,093,024 | A | * | 9/1937 | Williams | 249/135 |
| 2,166,587 | A | * | 7/1939 | Gathmann | 428/585 |
| 2,234,634 | A | * | 3/1941 | Ramsey et al. | 249/96 |
| 2,282,462 | A | * | 5/1942 | Dornin | 428/585 |
| 2,282,463 | A | * | 5/1942 | Dornin | 249/160 |
| 2,324,786 | A | * | 7/1943 | Byron | 249/106 |
| 2,358,171 | A | * | 9/1944 | Byron | 249/114.1 |
| 2,514,850 | A | * | 7/1950 | Dornin, Jr. | 249/160 |

(Continued)

FOREIGN PATENT DOCUMENTS

| | | | |
|---|---|---|---|
| CN | 1434752 | A | 8/2003 |
| JP | 55144307 | A * | 11/1980 |

(Continued)

OTHER PUBLICATIONS

Global Advisory Group GAG—Guidance, GAG Guidance Document 001, Terms and Definitions, Edition Jan. 2009, Mar. 2009, http://www.aluminum.org/Content/NavigationMenu/TheIndustry/IndustryStandards/GAG_Term_and_Definitions_-Edition_2009-01_-March_2009.pdf, Contents, Introduction and sections 2.4.10-14 at pp. 2/47, 3/47, 6/47, accessed Dec. 17, 2010.

(Continued)

*Primary Examiner* — Essama Omgba
(74) *Attorney, Agent, or Firm* — Dinsmore & Shohl LLP

(57) ABSTRACT

Method and apparatus for forming aluminum ingot having shaped ends to avoid alligatoring during rolling.

7 Claims, 6 Drawing Sheets

U.S. PATENT DOCUMENTS

| | | | | | |
|---|---|---|---|---|---|
| 2,829,410 | A | * | 4/1958 | Beaver, Jr. | 249/160 |
| 3,336,778 | A | * | 8/1967 | Follrath | 72/203 |
| 3,344,840 | A | * | 10/1967 | Buehl et al. | 164/122 |
| 3,422,656 | A | * | 1/1969 | Reinhardt et al. | 72/366.2 |
| 3,948,310 | A | * | 4/1976 | Deschapelles | 164/425 |
| 4,216,667 | A | * | 8/1980 | Otsuka et al. | 72/338 |
| 4,274,470 | A | * | 6/1981 | Yarwood et al. | 164/467 |
| 4,344,309 | A | | 8/1982 | Matsuzaki | 72/199 |
| 4,387,586 | A | | 6/1983 | Awazuhara et al. | 72/206 |
| 4,392,371 | A | * | 7/1983 | Okumura et al. | 72/231 |
| 4,486,509 | A | * | 12/1984 | Deschapelles et al. | 428/582 |
| 4,513,491 | A | * | 4/1985 | Bohnenkamp | 29/527.7 |
| 4,587,823 | A | | 5/1986 | Eibe | 72/206 |
| 4,593,551 | A | | 6/1986 | Otto, Jr. et al. | 72/240 |
| 4,608,850 | A | | 9/1986 | Ballantyne et al. | 72/240 |
| 4,635,704 | A | | 1/1987 | Chielens et al. | |
| 5,046,344 | A | * | 9/1991 | Ginzburg et al. | 72/19.9 |
| 6,056,040 | A | | 5/2000 | Weaver et al. | |
| 6,179,042 | B1 | * | 1/2001 | Perdue et al. | 164/483 |
| 6,334,978 | B1 | | 1/2002 | DeYoung et al. | |
| 6,453,712 | B1 | | 9/2002 | Klosterman et al. | 72/203 |
| 6,550,528 | B1 | | 4/2003 | Ichiki et al. | |
| 6,712,125 | B2 | | 3/2004 | Sample et al. | |
| 6,722,174 | B1 | * | 4/2004 | Nishii et al. | 72/41 |
| 6,932,147 | B2 | | 8/2005 | Evertz et al. | |
| 7,341,096 | B2 | | 3/2008 | Van Der Winden | |
| 7,819,170 | B2 | | 10/2010 | Anderson et al. | |
| 7,882,887 | B2 | | 2/2011 | Wagstaff et al. | |
| 8,096,160 | B2 | * | 1/2012 | Åkesson | 72/203 |
| 8,186,422 | B2 | | 5/2012 | Hennig et al. | |
| 2007/0209741 | A1 | | 9/2007 | Carpenter et al. | |
| 2008/0263851 | A1 | * | 10/2008 | Jha et al. | 29/527.7 |
| 2008/0295921 | A1 | | 12/2008 | Jha et al. | |
| 2009/0050290 | A1 | * | 2/2009 | Anderson et al. | 164/483 |
| 2011/0008642 | A1 | | 1/2011 | Anderson et al. | |
| 2012/0160442 | A1 | | 6/2012 | Anderson et al. | |

FOREIGN PATENT DOCUMENTS

| | | | | |
|---|---|---|---|---|
| JP | 56030008 | A | * | 3/1981 |
| JP | 56030009 | A | * | 3/1981 |
| JP | 56068507 | | | 6/1981 |
| JP | 57056101 | | | 4/1982 |
| JP | 57081902 | | | 5/1982 |
| JP | 57199502 | | | 12/1982 |
| JP | 58053301 | | | 3/1983 |
| JP | 58081501 | A | * | 5/1983 |
| JP | 60003950 | A | * | 1/1985 |
| JP | 60033803 | A | | 2/1985 |
| JP | 61135401 | A | * | 6/1986 |
| JP | 10156408 | A | * | 6/1998 |
| JP | 2003275801 | A | * | 9/2003 |
| JP | 55136501 | | | 10/2008 |
| RU | 2177381 | | | 12/2001 |
| SU | 1214255 | | | 2/1986 |

OTHER PUBLICATIONS

State Intellectual Property Office of People's Republic of China Decision of Rejection mailed Nov. 23, 2011 in reference to co-pending Chinese Pat. Appln. No. 200580047268X filed Dec. 16, 2005.

I.M. MacKenzie, "Influence of Ingot Shape on Yield From Slab Ingots," Journal of the Iron and Steel Institute, vol. 208, Part 4, pp. 342-347, Apr. 1970.

USPTO Non Final Rejection mailed Feb. 6, 2012 in reference to co-pending U.S. Appl. No. 12/215,149, filed Jun. 25, 2008.

Non-final U.S. Office Action pertaining to U.S. Appl. No. 12/215,179 dated Mar. 9, 2012.

Canadian Office Action pertaining to Application No. 2,595,251 dated Mar. 21, 2012.

EPO Notice of Intention to Grant pertaining to Application No. 05 854 646.6-2302 dated Apr. 16, 2012.

USPTO Office Action mailed Jul. 6, 2012 in reference to co-pending U.S. Appl. No. 12/215,149, filed Jun. 25, 2008.

USPTO Final Office Action mailed Jul. 20, 2012 in reference to co-pending U.S. Appl. No. 12/215,179, filed Jun. 25, 2009.

Korean first Office Action mailed Aug. 8, 2012 pertaining to co-pending Korean Patent Application Serial No. 10-2007-7017289.

* cited by examiner

The macro photograph showing the end shapes

The photograph showing close-up of the end shape after 55% hot rolling

Macro photograph showing side view of the two samples after 80% reduction

SHAPED DIRECT CHILL ALUMINUM INGOT

CROSS REFERENCE TO RELATED APPLICATION

This application is a continuation-in-part of U.S. Ser. No. 11/286,401, filed Nov. 25, 2005, now abandoned, which claims the benefit of U.S. Provisional Application No. 60/639,210, filed Dec. 27, 2004, incorporated herein by reference.

BACKGROUND OF THE INVENTION

This invention relates to casting aluminum ingot, and more particularly, it relates to aluminum ingots having shaped ends.

In the vertical casting of aluminum ingot, a shallow depression is left on the top of the ingot because of shrinking during solidification. The bottom end of the ingot is generally flat. During rolling of the ingot, the surface layers in contact with the rolls undergo larger deformation than inner layers of the ingot. This results in the top shallow depression and the flat end being extended when the ingot is rolled in the reversing mill. This has the problem that the depression forms what is referred to in the industry as an "alligator" type split at the ends of the rolled material. Even if the top depression is removed, the alligator split still forms due to the nature of rolling. The alligator splits must be removed, and this results in scrap which is a significant factor in determining recovery rate of the ingot. If the depression is not removed, it can result in processing problems down the line. Thus, there is a great need for a method and system to solve this problem in order to increase the recovery of metal from the ingot.

In the past, several approaches have been used to resolve this problem. For example, U.S. Pat. No. 6,453,712 discloses a method and apparatus for reducing crop losses during slab and ingot rolling concerns the formation of a slab ingot having a specially configured or shaped butt end and optionally a head end as well. A special shape is formed by machining, forging or preferably by casting. The special shape at the butt end is imparted during casting by a specially shaped bottom block or starter block. The special shape of the bottom block is imparted to the cast ingot butt end. The specially shaped butt end of a slab shaped ingot is generally rectangular in shape and has longitudinally outwardly extending, enlarged portions, which slope downwardly toward a depressed central valley region. The lateral sides of the enlarged end portions and the depressed valley region carry transversely extending, tapered or curved edges. A similar shape may be imparted to the head end of the ingot at the conclusion of a casting run through the use of a specially shaped hot top mold or by way of machining or forging the cast head end. During subsequent hot rolling in a reversing roughing mill, the specially shaped slab ingot minimizes the formation of overlap and tongue so as to improve material recovery by reducing end crop losses and to increase rolling mill efficiency by increasing metal throughput in the mill.

U.S. Pat. No. 4,344,309 discloses a process which includes a method during slabbing, in which, recesses in the thicknesswise direction are formed on a pair of opposite surfaces at each end of the top and bottom of said steel ingot, subsequently, the central portions which have not been rolled, are rolled to the depth of said recesses, then, recesses in the widthwise direction are formed at the same end as described above, next, the central portions, which have not been rolled, are rolled to the depth of said recess in the widthwise direction; and, when the thicknesswise reduction value is $\Delta H_T$ and the widthwise reduction value is $\Delta H_W$ in said thicknesswise and widthwise reduction rollings, $\Delta H_W/\Delta Ht$ is regulated to 0.40~0.65 in a region where the material has a comparatively large thickness and the side profile of the material presents a double barrelling, and $\Delta H_W/\Delta H_T$ is regulated to 0.3 or less in a region where the thickness of the material has a comparatively small thickness and the side profile of the material presents a single barrelling; whereby fishtails are prevented from growing so that crop loss consisting of fishtails and double-plate shaped overlaps can be reduced, thereby improving the rolling yield to a considerable extent.

U.S. Pat. No. 4,587,823 discloses an apparatus and method which makes possible the semicontinuous rolling of an extensive range of product widths from no more than three widths of slabs. The leading end of a slab is forged or upset laterally between dies tapered to reduce its width at said end gradually to a value less than the desired width at the end of the pass. The slab is then passed through grooved vertical edging rolls to reduce its width and into the rolls of a roughing stand. The edge rolling tends to move the overfilled metal into the void created by the dies. As the trailing end of the slab approaches the roughing stand the edging rolls are backed off, allowing that end of the slab to fan out laterally. As the slab leaves the roughing stand it is rolled between grooved vertical edging rolls to reduce spread and bring the fanned-out trailing end to size. That operation causes the trailing end to bulge rearwardly at its center, so compensating for fishtailing. The roughing stand is then reversed and the slab rerolled in the opposite direction in the same way.

U.S. Pat. No. 1,603,518 discloses a method of rolling ingots to avoid ears or cupped ends on the same which comprises providing an ingot having predetermined end dimensions, and predetermining the heat of the ingot and the depth of reduction relatively to the said end dimensions to cause the effective extrusion forces to be active over the total end area to move the end surface substantially uniformly relatively to the body of the ingot.

U.S. Pat. No. 4,608,850 discloses a method of operating a rolling mill in a manner that avoids the occurrence of alligatoring in a slab of metal as it is reduced in thickness in the mill. The slab is subject to a schedule of repeated passes through the mill to effect a predetermined amount of reduction in thickness of the slab in each pass. The method comprises the steps of analyzing the pass schedule of such a slab, and noting any pass in the schedule that has a combination of entry gauge and reduction draft that may subject the slab to alligatoring. An untapered nose of the slab is next presented to the bite of the mill, and if the combination of entry gauge and reduction draft is one that is not subject to alligatoring, the slab is passed through the mill to reduce its thickness as scheduled. However, if the combination of entry gauge and reduction draft is one that causes or tends to cause alligatoring in the slab, the method changes the size of the working gap of the mill by an amount that changes the combination of entry gauge and reduction draft to one that does not subject the slab to alligatoring. The nose of the slab is then directed to the bite of the mill having the changed working gap, and, once the nose of the slab has entered the bite of the mill, the working gap thereof is returned to the size that will effect the schedule reduction and thickness of the slab.

U.S. Pat. No. 4,593,551 discloses a method of reducing the thickness of a slab of metal under conditions that tend to produce alligator defects in the ends of the slab, the method comprising the steps of tapering at least one end of the slab and directing the same into a rolling mill. The tapered end of the slab is reduced in thickness in the mill, the amount of reduction increasing as the tapered end passes through the mill. The slab continues through the mill to reduce the thickness of the same. The end of the slab is again tapered and directed again through a rolling mill, with each of said tapers providing combinations of entry thickness to thickness reduction such that the reduction taken in the area of each taper is in an entry thickness to thickness reduction zone that does not produce alligatoring in the ends of the slab. The remaining untapered portion of the slab is reduced in thickness in the mill in an entry thickness to thickness reduction zone in which alligator formation tends to occur.

U.S. Pat. No. 4,387,586 discloses a method and apparatus for rolling a rolled material widthwise thereof wherein the rolled material in the form of a flat metal which may be a slab of metal having a large width as contrasted with the thickness has its lengthwise end portion shaped by compression working while the rolled material remains stationary in such a manner that the lengthwise end portion is formed with a progressively reducing width portion in which the width is progressively reduced in going toward the end of the rolled material, and a uniform width portion contiguous with the progressively reducing width portion and having a width equal to the minimum width of the progressively reducing width portion between its end contiguous with the progressively reducing width portion and the end of the rolled material. Thereafter, the rolled material is subjected to widthwise rolling, whereby the fishtail produced at the end of the rolled material can be greatly diminished.

In spite of the above, there is a great need for an economical process and system which resolves the problem of alligator splits to increase the recovery of metal from the ingot and to reduce scrap.

SUMMARY OF THE INVENTION

It is an object of this invention to improve the recovery of rolled metal from ingot.

It is another object of this invention to provide a novel method for casting ingot.

Still, it is another object of this invention to provide a novel shaped ingot end during casting which will not form alligator splits during rolling.

It is still another object of the invention to provide a novel bottom block for use in casting of molten aluminum.

Yet, it is another object of the invention to provide a novel end shape on an ingot to reduce or eliminate end splitting of the ingot during rolling to a thinner gauge.

These and other objects will become apparent from the specification, drawings and claims appended hereto.

In accordance with these objects, there is disclosed a method of rolling an ingot of aluminum to avoid alligatoring as the ingot is reduced in thickness to produce a slab or sheet, the ingot being rolled in a rolling mill wherein the ingot is subject to multiple rolling passes. The method comprises providing a rolling mill and providing an ingot to be rolled, the ingot comprising opposed surfaces to be rolled and having at least one shaped or formed end. The shaped end comprises a tapered portion, the taper being in the direction of rolling, and being in the range of 2° to 20° from the surface to be rolled and extending into the thickness of the ingot towards the end of the ingot. The shaped end has an outwardly curved or rounded surface continuous with the tapered surface, the curved or rounded surface extending across the rolling direction to provide a formed end. The ingot is subject to multiple rolling passes in the rolling mill to reduce the ingot in thickness and extend the ingot in length to produce a slab or sheet, the slab or sheet being free of alligatoring.

The invention also includes a method of producing an aluminum ingot having a formed end to avoid alligatoring as the ingot is reduced in thickness during rolling, the ingot being rolled in a rolling mill wherein the ingot is subject to multiple rolling passes. The method comprises providing a caster for casting aluminum ingot, the caster comprising a rectangular shaped mold and bottom block fitted therein to start casting the ingot having the formed end. The bottom block has an upper surface for receiving molten aluminum, the upper surface having two opposed faces tapered inwardly towards each other and terminating in a rounded end to provide a shaped or formed end on a cast ingot for rolling. After casting, the cast ingot has at least one shaped end comprising two surfaces tapered inwardly towards the end, the taper transverse to direction of rolling, and being in the range of 2° to 20° from the surface to be rolled. The shaped end further comprises an outwardly curved or convex surface continuous with the tapered surface, the curved surface extending transverse to the rolling direction to provide the shaped or formed end. Molten aluminum is provided for casting into an ingot. The cast ingot is subject to multiple rolling passes in the rolling mill to reduce the ingot in thickness and extend the ingot in length to produce a slab or sheet free of alligatoring.

The invention also includes a specially shaped bottom block for producing the shaped ingot end which minimizes alligatoring during subsequent rolling. Controlling the ingot end shape in accordance with the invention greatly minimizes scrap generation when rolling. Further, at the end of the cast, a top mold may be used to form the shaped end at the top of the ingot.

DETAILED DESCRIPTION OF PREFERRED EMBODIMENTS

Figure 1:
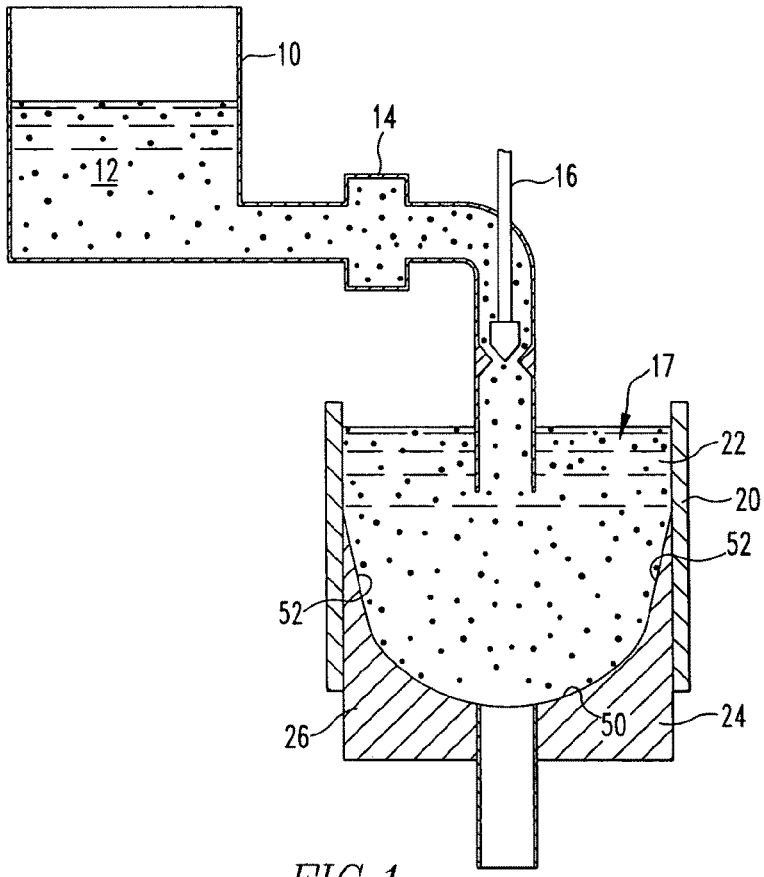
FIG. 1 is a cross-sectional view illustrating an apparatus for casting molten aluminum into ingots.

Referring now to FIG. 1, there is illustrated a preferred embodiment of the invention for casting aluminum ingot. In FIG. 1, there is shown a holding furnace 10 containing molten aluminum 12. The molten aluminum may be passed through filter box 14 to remove any small particles. Thereafter, the molten aluminum is metered through metering rod 16 to molten metal pool 17 in mold 20 where it is solidified into solid ingot 22 which is supported by bottom block 24. Bottom block 24 is lowered at a rate commensurate with the solidification rate of pool 17. Block 24 is shown having a cross-sectional configuration in accordance with the invention.

Figure 2:
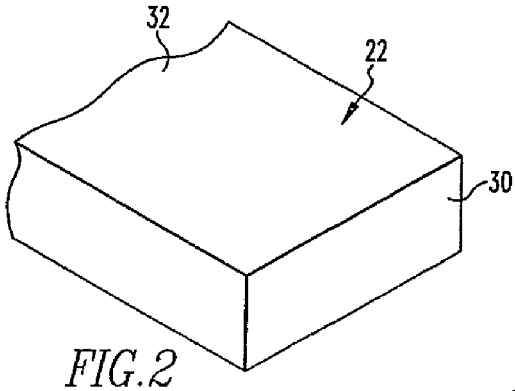
FIG. 2 PRIOR ART
FIG. 2 is a dimensional view of the end of a conventional aluminum ingot.
Figure 5:
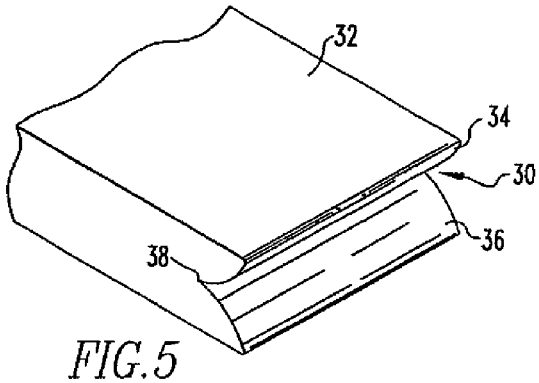
FIG.5 PRIOR ART
FIGS. 5 and 6 illustrate the shape ingot end shapes in FIGS. 2-4 after 55% reduction by hot rolling.
Figure 7:
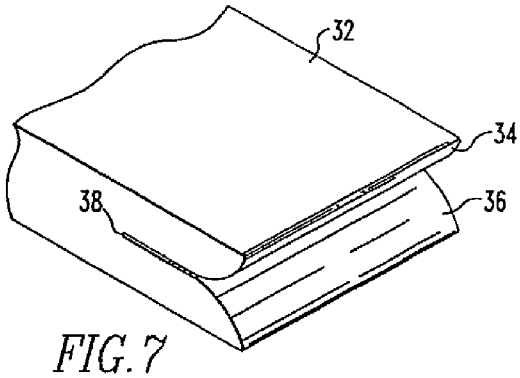
FIG.7 PRIOR ART
FIGS. 7 and 8 illustrate the shape ingot end shapes in FIGS. 2-4 after 80% reduction by hot rolling.
Figure 8:
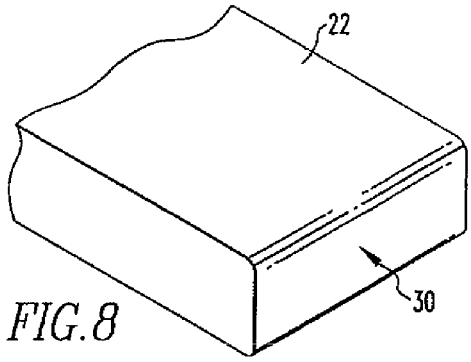

In conventional ingot casting, end 30 (FIG. 2) of the ingot is substantially flat with little or no curvature provided on the end of the ingot. The ingot has a large, flat top side and a bottom side substantially parallel to the top side. However, as noted herein, such conventional ingot, upon rolling, the surface layers will undergo a larger deformation than the inner layers. This results in the surface layers comprising the top surface and bottom surface of the ingot extending over the inner or central layers of metal. The results of rolling such conventional ingot are shown in FIG. 5, for example, where it will be noted that top and bottom layers 34 and 36 of metal extends over the inner or center layers of metal 38. This problem is aggravated depending on the amount of rolling. For example, at about 80% reduction in thickness by hot rolling, the metal on top and bottom layers 34 and 36 can extend further to form what is termed in the art as "alligator" type splits (see FIG. 7). It will be appreciated that such splits must be removed which results in large amounts of metal being scrapped. Thus, it will be seen that there is a great need to provide an ingot which is not subject to alligator splits.

Figure 3:
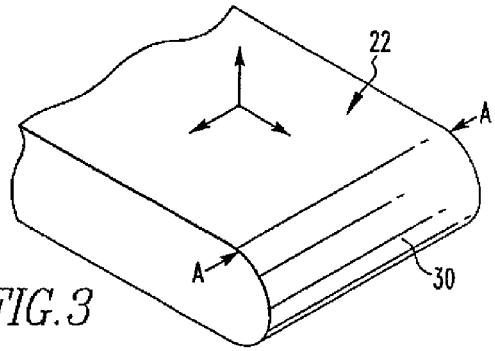
FIGS. 3 and 4 (A, B, C) are dimensional views of the end of an ingot in accordance with the invention.
Figure 4A:
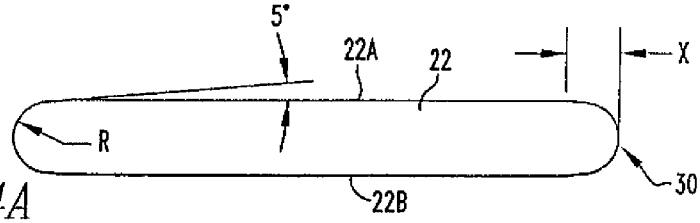
Figure 4B:
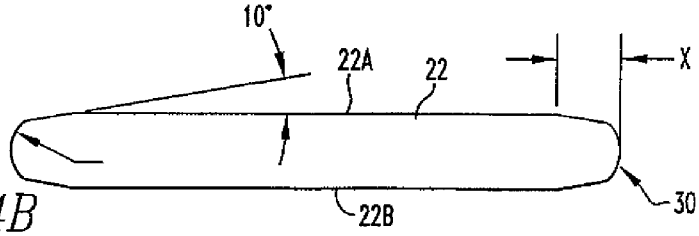
Figure 4C:
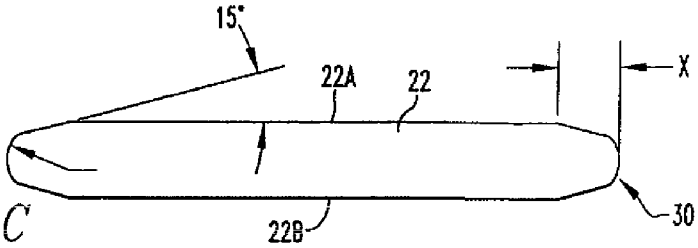

The present invention provides such an ingot. It has been discovered that the end of the ingot can be shaped to avoid formation of alligator splits. That is, it has been discovered that if the end of ingot is provided with a curve or rounded end, as shown for example in FIG. 3, the end of the ingot is free from splits upon rolling. The shape referred to preferably approximates a half circle which extends along the width A-A of the ingot. A circular arc of about 10° to 70° at the end of the ingot across the thickness may be used, as shown in FIGS. 4A-4C. Also, tapers of 2° to 20° into top surface 22A and bottom surface 22B may be used.

Figure 9:
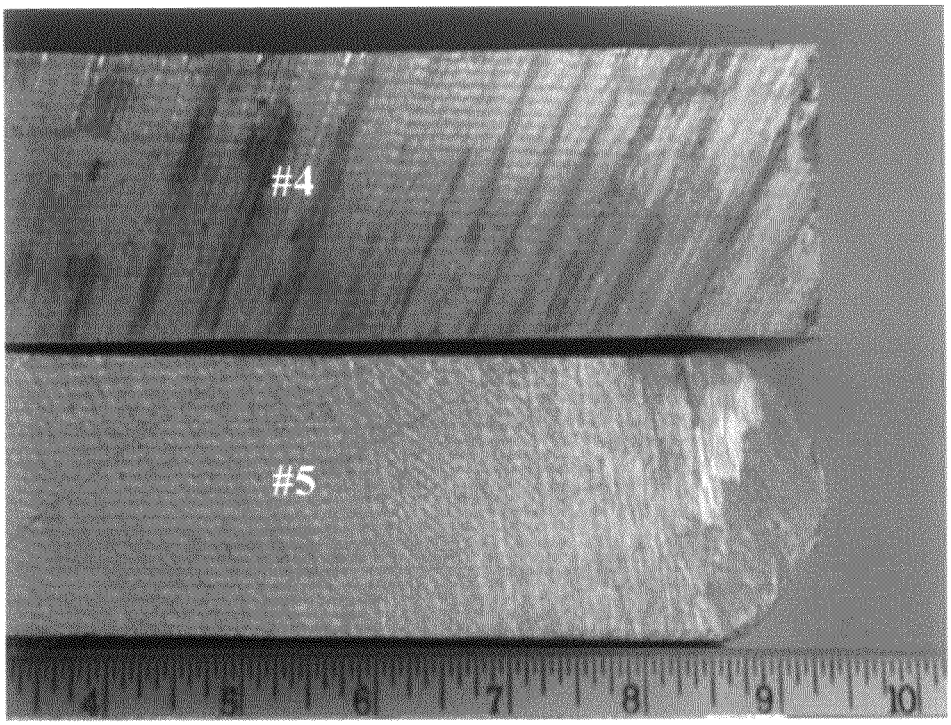
FIG. 9 is a macro photograph of two samples to be rolled.
Figure 10:
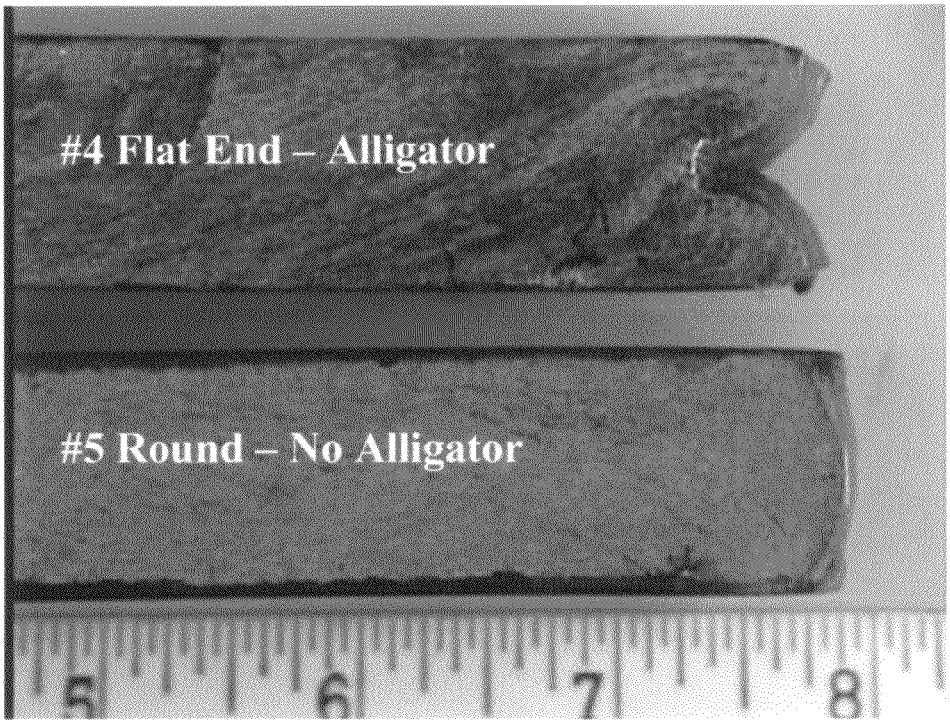
FIG. 10 is a macro photograph of two samples of FIG. 9 after hot rolling to 55% reduction in thickness.
Figure 11:
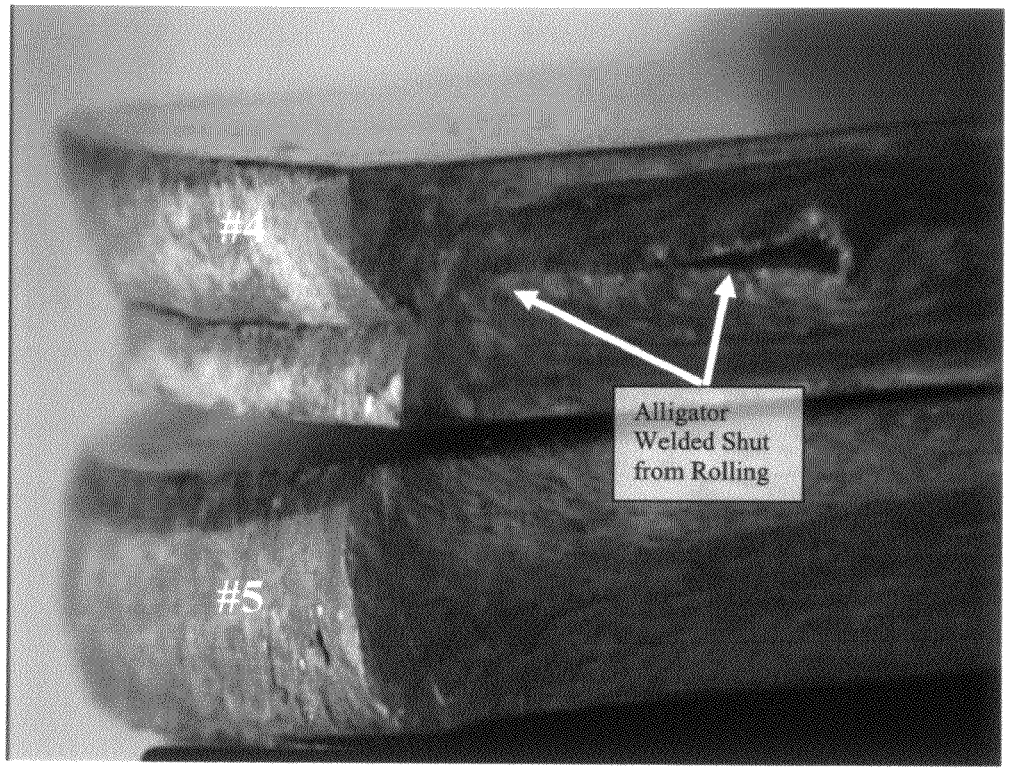
FIG. 11 is a macro photograph of two samples of FIG. 9 after hot rolling to 80% reduction in thickness.

To illustrate the invention, reference is made to FIGS. 9, 10 and 11, which show photographs of slabs to be rolled or after rolling. In FIG. 9, there are shown two slabs of aluminum for rolling. It should be noted that the top slab has a conventional square or flat end and the bottom slab has rounded end in accordance with the invention. Referring to FIG. 10, there is shown the metal flow at the ends or end shape after each slab was hot rolled to reduce the thickness 55%. It should be noted that the conventional flat end developed an alligator split or shape and the rounded end was reduced in thickness without alligator splits in accordance with the invention.

Referring now to FIG. 11, it will be seen that the alligatoring becomes more extensive for the conventional flat end when it is rolled to an 80% reduction. In this view, it will be seen that the split extends further into metal and the metal layers become laminated. In comparison, the ingot having the rounded end does not exhibit any alligator splits even after 80% reduction in thickness. As noted earlier, the splits must be cut or cropped off to make the rolled metal useful, resulting in considerable amounts of metal being scrapped.

Figure 6:
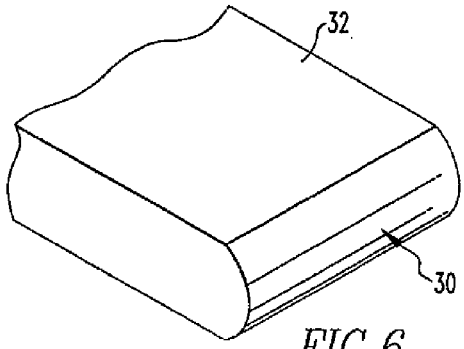

Preferably, the ingots useful in the invention have a large flat top side and large bottom side. As shown in FIG. 3 or 6, for example, typically the ingots have shorter sides to provide a rectangular cross section of ingot. Typically, the large flat side of the ingot is rolled in the direction of the end, and the ingot is thereby extended in length. It should be noted that rolling in the direction of the end extends the length of the ingot and has virtually no effect on the sides.

Preferred embodiments of the invention are shown in FIGS. 4*a, b* and *c*. In FIG. 4*a*, there is shown of a schematic of an ingot 22 having shaped ends in accordance with the invention. Thus, the shaped ends are first prepared by providing a tapered portion having a taper between 2° and 20°. A 5° taper is shown in FIG. 4*a* and extends across the width of the ingot or slab in a direction transverse to the rolling direction. The taper can extend for the distance X (FIG. 4*a*). The tapered portion terminates in a rounded portion 30, preferably the rounded portion comprises a section of a circle having the radius R. The radius R depends on the thickness of the ingot or slab. For the greater taper, e.g., 15°, it will be seen that the radius is smaller for the same thickness of ingot.

The specially shaped end on the ingot may be made by machining, forging or pressing. However, preferably the shaped end is formed during casting. As noted, this is achieved by casting an ingot using a specially shaped bottom block 24, for example, as shown in FIG. 1. By examination of FIG. 1, it will be seen that bottom block 24 has a curved or rounded surface 50 and a tapered section 52. Thus, as molten metal 12 is introduced to mold 20 and contained by bottom block 24, the molten metal takes the shape of the interior surface as defined by surfaces 50 and 52. The top end of the ingot may also be shaped using a top mold of the required shape to end the ingot cast wherein the top mold is filled with molten metal. The top mold may be an adjustable hot top mold or an adjustable conventional or EMC mold. Thus, the ingot can be rolled with greatly reduced scrap. Alternatively, the top end of the ingot can be prepared by machining or using a press or forge having dies of the required configuration.

Figure 12:
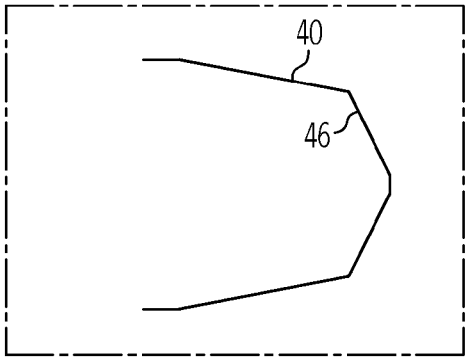
FIG. 12 is a cross-sectional view of the end of an ingot showing a 10° taper.
Figure 13:
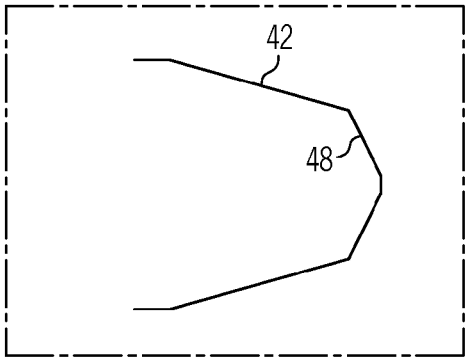
FIG. 13 is a cross-sectional view of the end of an ingot showing a 15° taper.
Figure 14:
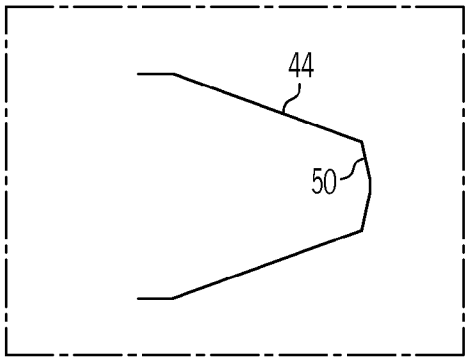
FIG. 14 is a cross-sectional view of the end of an ingot showing a 20° taper.

Three ingots 3014 were cast and scalped and then machined to the shapes shown in FIGS. 12, 13 and 14. Ingot 1 was given a first 10° taper 40, ingot 2 a 15° taper 42, and ingot 3 a 20° taper 44. A second portion was machined off the end of ingots 1, 2 and 3. A second taper 46 made an angle of 64° from the horizontal for ingot 1, taper 48 had an angle of 62° for ingot 2, and taper 50 had an angle of 78° for ingot 3. It will be appreciated that the first taper can range from 2° to 25°, and the second taper can range from about 50° or less to about 80°. The ingots were then heated for hot rolling. The ingots were hot rolled from a thickness of about 28 to 1.2 inches without formation of alligators.

What is claimed is:

1. A method of rolling an ingot of aluminum, the method comprising:

(a) providing an aluminum ingot to be rolled, said aluminum ingot comprising at least one formed end having opposed tapered surfaces extending a distance from a flat surface of said aluminum ingot across a widthwise dimension opposite a rolling direction, said tapered surfaces being provided at a first angle in a range of 2° to 20° from said surface of said aluminum ingot and a second angle in the range of 50° to 80° from said flat surface of said cast aluminum ingot and extending a distance from said first angle towards said formed end; and (b) subjecting said aluminum ingot to multiple rolling passes in a rolling mill to reduce said aluminum ingot in thickness and extend the aluminum ingot in length to produce a sheet having a rolled end, said rolled end of said shet being free of alligatoring.

2. The method in accordance with claim 1 wherein said first angle is in the range of 5° to 15°.

3. The method in accordance with claim 1 wherein said tapered surfaces of said formed end terminate in a rounded portion.

4. The method in accordance with claim 1 wherein said aluminum ingot comprises a second formed end.

5. The method in accordance with claim 1 wherein at least one of said ends of said aluminum ingot is formed during casting from a shape of a bottom block onto which aluminum is poured during casting.

6. The method in accordance with claim 1 wherein at least one of said ends of said aluminum ingot is formed by machining after said aluminum ingot is formed.

7. The method in accordance with claim 1 wherein the at least one formed end of said aluminum ingot and a second formed end are formed during casting.

* * * * *

UNITED STATES PATENT AND TRADEMARK OFFICE

CERTIFICATE OF CORRECTION

PATENT NO. : 8,381,385 B2
APPLICATION NO. : 12/218438
DATED : February 26, 2013
INVENTOR(S) : Gyan Jha et al.

It is certified that error appears in the above-identified patent and that said Letters Patent is hereby corrected as shown below:

In the Claims

Col. 6, Claim 1, Line 56, "from said surface" should read --from said flat surface--; and Col. 6, Claim 1, Line 65, "said shet" should read --said sheet--.

Signed and Sealed this
Eleventh Day of June, 2013

Teresa Stanek Rea
*Acting Director of the United States Patent and Trademark Office*